US010418020B2

(12) United States Patent
Lewandowski et al.

(10) Patent No.: US 10,418,020 B2
(45) Date of Patent: Sep. 17, 2019

(54) VEHICLE ADAPTIVE CRUISE CONTROL NOISE CANCELATION

(71) Applicant: Ford Global Technologies, LLC, Dearborn, MI (US)

(72) Inventors: Andrew Denis Lewandowski, Sterling Heights, MI (US); Jason Christopher Matthews, Farmington Hills, MI (US); Grant Mayer, Canton, MI (US); Kenneth Andrew Hanovich, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 32 days.

(21) Appl. No.: 15/845,247

(22) Filed: Dec. 18, 2017

(65) Prior Publication Data

US 2019/0189104 A1 Jun. 20, 2019

(51) Int. Cl.
*G10K 11/178* (2006.01)
*G10K 15/02* (2006.01)

(52) U.S. Cl.
CPC ..... *G10K 11/178* (2013.01); *G10K 15/02* (2013.01); *G10K 2210/1282* (2013.01)

(58) Field of Classification Search
CPC ..... G10K 11/178; G10K 15/02; G10K 2210/1282
USPC ..... 381/66
See application file for complete search history.

(56) References Cited

U.S. PATENT DOCUMENTS

2007/0216224 A1 9/2007 Schmitt et al.
2008/0192954 A1* 8/2008 Honji ..... G10K 15/04 381/86
2014/0183933 A1 7/2014 Kuhlman
2015/0283985 A1 10/2015 Korthals et al.
2016/0086592 A1* 3/2016 Saxman ..... G10K 11/178 381/71.4

FOREIGN PATENT DOCUMENTS

CN 104986135 A 10/2015
KR 20130138011 A 12/2013

* cited by examiner

*Primary Examiner* — Paul Kim
*Assistant Examiner* — Douglas J Suthers
(74) *Attorney, Agent, or Firm* — Frank Lollo; Neal, Gerber & Eisenberg LLP; James P. Muraff

(57) ABSTRACT

Method and apparatus are disclosed for reducing noise caused by a vehicle brake system. An example vehicle includes an adaptive cruise control (ACC) system, a noise cancellation system, a brake system, and a processor. The processor is configured to receive a deceleration request while the ACC is active, determine a braking characteristic based on the deceleration request, determine a noise signal based on the braking characteristic, and output the noise signal via the noise-cancellation system.

19 Claims, 3 Drawing Sheets

102 = ACC system
104 = noise cancellation system
106 = brake system
108 = sensors
110 = processor

VEHICLE ADAPTIVE CRUISE CONTROL NOISE CANCELATION

TECHNICAL FIELD

The present disclosure generally relates to vehicle noise cancellations and, more specifically, vehicle adaptive cruise control noise cancellation.

BACKGROUND

Vehicles may include sources of noise both caused by the vehicle and by objects in the environment. Noise can cause a driver's experience to be diminished. Some modern vehicles may include noise cancellation technology configured to cancel out noise and provide a quieter in-cabin environment.

Some vehicles may also include adaptive cruise control (ACC). ACC may enable a given vehicle to modify the speed of the vehicle based on one or more inputs, such that driver comfort is improved by speeding up or slowing down the vehicle.

SUMMARY

The appended claims define this application. The present disclosure summarizes aspects of the embodiments and should not be used to limit the claims. Other implementations are contemplated in accordance with the techniques described herein, as will be apparent to one having ordinary skill in the art upon examination of the following drawings and detailed description, and these implementations are intended to be within the scope of this application.

Example embodiments are shown describing systems, apparatuses, and methods for removing noise caused by an ACC during operation of the ACC system. An example disclosed vehicle includes an adaptive cruise control (ACC), a noise cancellation system, a brake system, and a processor. The processor is configured to receive a deceleration request while the ACC is active, determine a braking characteristic based on the deceleration request, determine a noise signal based on the braking characteristic, and output the noise signal via the noise-cancellation system.

An example disclosed method for canceling vehicle noise includes receiving, by a vehicle processor, a deceleration request while an adaptive cruise control is active. The method also includes determining a braking characteristic of a brake system based on the deceleration request. The method further includes determining a noise signal based on the braking characteristic. And the method yet further includes outputting the noise signal via a noise-cancellation system.

BRIEF DESCRIPTION OF THE DRAWINGS

For a better understanding of the invention, reference may be made to embodiments shown in the following drawings. The components in the drawings are not necessarily to scale and related elements may be omitted, or in some instances proportions may have been exaggerated, so as to emphasize and clearly illustrate the novel features described herein. In addition, system components can be variously arranged, as known in the art. Further, in the drawings, like reference numerals designate corresponding parts throughout the several views.

DETAILED DESCRIPTION OF EXAMPLE EMBODIMENTS

Figure 1:
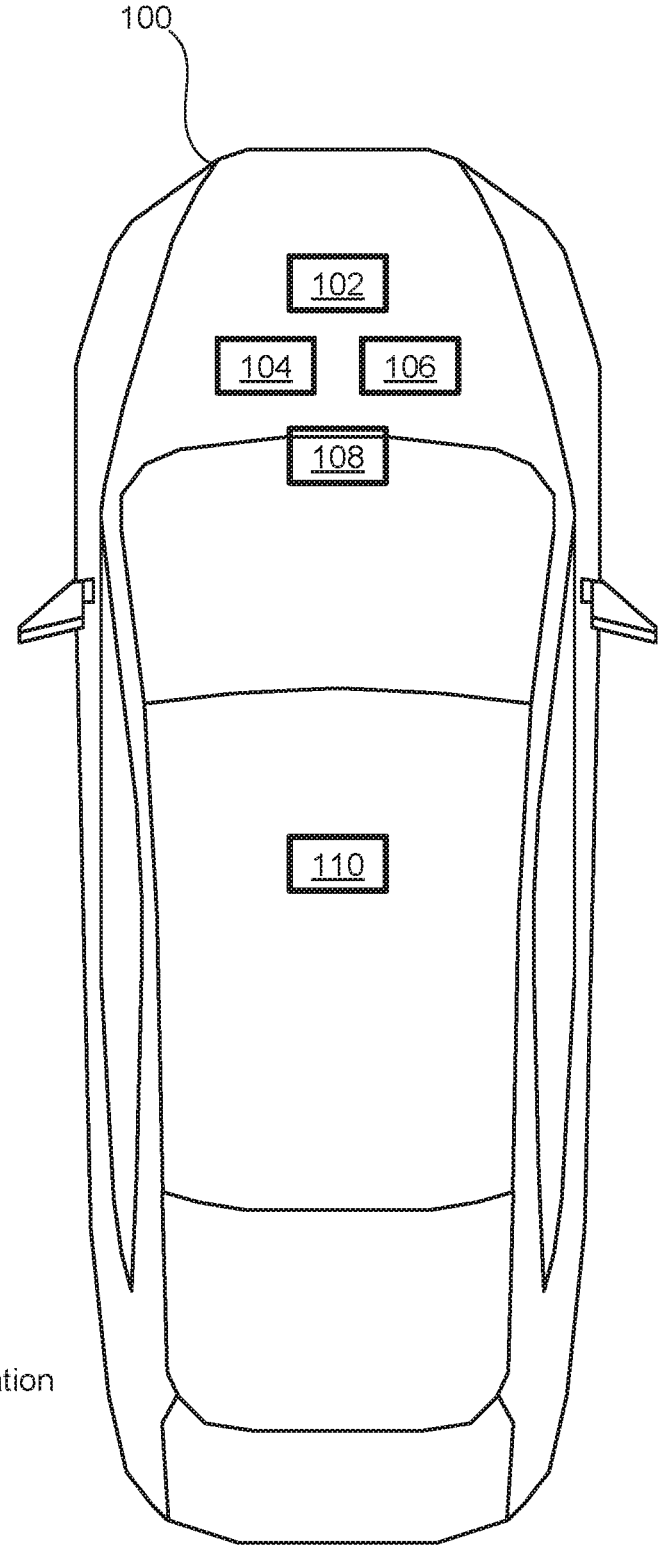
FIG. 1 illustrates an example vehicle according to embodiments of the present disclosure.

While the invention may be embodied in various forms, there are shown in the drawings, and will hereinafter be described, some exemplary and non-limiting embodiments, with the understanding that the present disclosure is to be considered an exemplification of the invention and is not intended to limit the invention to the specific embodiments illustrated.

As noted above, vehicle may include many sources of noise that occur both inside and outside the vehicle. It may be beneficial for high end vehicles in particular to remove as much noise as possible from the vehicle cabin, to provide the most noise-free user experience possible.

Some vehicles include brake systems that include brake fluid which must be pushed into the calipers of the brake system in order to slow the vehicle. Under non-cruise control conditions, the power required to push the brake fluid into the calipers may be supplied by the driver. The driver may press the brake pedal, which in combination with a brake booster may cause the fluid to enter the calipers and slow the vehicle.

However where adaptive cruise control (ACC) is used, the vehicle may be requested to slow down automatically without the driver pressing the pedal and supplying power to push the brake fluid. Instead, one or more motors, pumps, or other mechanical mechanisms may be engaged to push the brake fluid into the calipers. For example, a vehicle brake system may include a motor that can spin to run a pump and push brake fluid into the calipers. However the motors, pumps, and/or valves used to apply the brakes may produce noise and vibration which is undesired.

With these issues in mind, example embodiments of the present disclosure may include determining when noise caused by the braking system is likely to occur, and making use of a vehicle noise cancellation system to emit a signal out of phase with noise caused by the braking system, thereby reducing or eliminating the noise inside the vehicle cabin.

An example vehicle may have an ACC system. While the ACC system is active, the vehicle may receive a deceleration request based on one or more sensor inputs or user interface inputs. The deceleration request may indicate that the vehicle should slow down by a given amount, in order to avoid a collision and maintain a safe distance from other nearby vehicles. The processor may determine one or more braking characteristics based on the received deceleration request. The braking characteristics can include a target vehicle speed (to which the vehicle should be reduced), a target deceleration amount, a target jerk amount, a duration over which the brakes should be applied, an intensity at which the brakes should be applied, or any other characteristic or combination of characteristics related to a reduction in speed of the vehicle.

Then, based on the determined braking characteristic (or characteristics), the processor may determine a noise signal. The noise signal may be selected from a plurality of stored noise signals, and may correspond to the frequency and magnitude of the noise expected to be caused by the brake system based on the determined braking characteristic. In other words, the processor may predict that a given noise signal will be produced by the braking system based on the braking characteristic. And in response, the processor may select a corresponding noise signal that is out of phase by 180 degrees that can be output into the vehicle cabin in order to cancel out the noise produced by the brake system. This and other features will be discussed in more detail with respect to FIGS. 1-3.

FIG. 1 illustrates an example vehicle 100 according to embodiments of the present disclosure. Vehicle 100 may be a standard gasoline powered vehicle, a hybrid vehicle, an electric vehicle, a fuel cell vehicle, or any other mobility implement type of vehicle. Vehicle 100 may be non-autonomous, semi-autonomous, or autonomous. Vehicle 100 may include parts related to mobility, such as a powertrain with an engine, a transmission, a suspension, a driveshaft, and/or wheels, etc. In the illustrated example, vehicle 100 may include one or more electronic components (described below with respect to FIG. 2).

As shown in FIG. 1, vehicle 100 may include an ACC system 102, a noise cancellation system 104, a brake system 106, sensors 108, and a processor 110.

The ACC system 102 may be configured to provide automatic control of the speed of vehicle 100, by maintaining a given speed or distance from a leading vehicle, or by accelerating or decelerating the vehicle. The ACC system may be active (i.e., currently operating and controlling the vehicle speed) or inactive (i.e., not controlling the vehicle speed).

When the ACC system 102 is active, it may receive acceleration and/or deceleration requests from the processor 110, a user interface, one or more vehicle sensors 108, a communication module, or any other device or system of vehicle 100. The request may be based on a desire to maintain a vehicle speed over an incline or decline in a road, or to maintain a safe distance from a leading vehicle, for example.

The ACC system may be configured to transmit a control signal to the brake system 106. In order to apply the brakes, the brake system 106 may include one or more motors, pumps, valves, and other mechanical mechanisms to apply brakes. In some examples, a motor may spin at a high RPM to cause a pump to push fluid into calipers to cause deceleration of vehicle 100.

Other types of brake systems may be used as well, including brake systems in which a motor or other mechanical mechanism is used to apply brakes automatically without a driver's foot depressing the brake pedal.

In some examples, sensors 108 may provide data used by the ACC system 102 to speed up, slow down, or otherwise adjust one or more settings or characteristics of the ACC system 102.

The noise cancellation system 104 may be configured to reduce noise in vehicle cabin that may come from a variety of sources. Some noise may be caused by operation of the vehicle itself (e.g., wheels on the road, the engine running, etc.) while other noise may be caused by outside sources (e.g., other vehicles, people, etc.).

The noise cancellation system 104 may reduce noise by emitting a signal that is out of phase with the noise, such that destructive interference occurs. The out of phase signal may be emitted by one or more speakers located throughout the vehicle cabin.

In some examples, the noise cancellation system 104 may include one or more microphones positioned inside or outside the vehicle cabin in order to capture signals from one or more noise sources. The captured signals may then be processed in order to determine one or more characteristics of an out of phase signal that can be used to reduce the noise.

With respect to noise from the brake system in particular, a microphone may be configured to capture noise from the brake system and determine a magnitude of an output signal used to cancel or destructively interfere with the brake system noise. For instance, where the brake system noise is particularly loud, the output signal magnitude may be increased.

In some examples, one or more devices or systems of vehicle 100 may be configured to measure and/or store noise from the brake system 106 over time. The history of measured noise may be processed in order to model or determine how the brake system noise changes over time. And one or more output characteristics of the ACC system 102 may be modified based on the determined model or changes in brake system noise over time.

As noted above, the brake system 106 may include one or more motors, pumps, valves, or other mechanical components. When the brake system operates, a motor may spin up to a relatively high RPM (e.g., 2000-3000 RPM or more) in order to push brake fluid into the brake calipers to slow the vehicle. The values used in this disclosure are for illustration only, and may change depending on one or more characteristics of the motor, pump, valves, or other brake system components.

Operation of the brake system 106 may generate a noise signal. The generated noise signal may have one or more signal characteristics (e.g., frequency, magnitude, etc.) that depend on the motor or pump RPM, the duration of use, the speed of the vehicle, and/or many other characteristics.

Further, the generated noise signal may be correlated with a deceleration request. For instance, where the deceleration request indicates that the vehicle should decelerated by one meter per second over a period of two seconds, the brake system may be responsively instructed to apply the brakes with a given intensity for two seconds. And this may correspond to a known motor speed and duration, which in turn may correspond to a known noise signal.

Sensors 108 of vehicle 100 may include a microphone, accelerometer, and one or more cameras, radar, LIDAR, and more. Some sensors 108 may facilitate communication with one or more nearby vehicles to maintain a safe distance and warn of upcoming obstacles or emergency situations.

The sensors 108 may be configured to measure a vehicle speed, acceleration, jerk or more. As such, sensors 108 may be positioned inside or outside the vehicle cabin.

The processor 110 may be configured to receive data from one or more vehicle devices or systems, and control one or more other devices or systems described herein, such as the ACC, noise cancellation system, braking brake system 106, and sensors 108.

In some examples, processor 110 may be configured to receive a deceleration request while the ACC is active or operating. The deceleration request may come from one or more sensors 108 (e.g., where the ACC system is tasked with maintaining a set distance from a leading vehicle). In this case, the sensors may detect a decreasing distance between vehicle 100 and a leading vehicle, and may responsively transmit a deceleration request to the processor 110.

For example, a camera, radar, LIDAR, or other sensors may be configured to determine a distance between vehicle 100 and a leading vehicle in front. If the distance becomes smaller than a threshold, then a deceleration request may be generated in order to cause the vehicle to slow down. As such, a deceleration request may be generated based on a position of the leading vehicle with respect to vehicle 100.

Alternatively, the vehicle 100 may include a user interface to enable a driver to interact with the ACC system 102. One or more buttons may be provided to the driver, or other input devices may be used, that may enable the driver to request an increase or decrease in speed. A requested decrease in speed by the driver may cause a deceleration request to be generated having one or more braking characteristics based on the request from the driver (e.g., based on the target speed, etc.).

Once a deceleration request is received by the processor 110, one or more braking characteristics may be determined based on the deceleration request.

Braking characteristics may comprise one or more values associated with or corresponding to the deceleration request. For example, a non-exhaustive list of braking characteristics corresponding to a deceleration request may include (a) a current speed, (b) a requested or target speed, (c) a difference between the current speed and a target speed (d) a current acceleration or deceleration, (e) a target or requested amount of acceleration or deceleration, (f) a current jerk, (g) a target or request amount of jerk, (h) a duration over which the brakes should be applied, (i) a pattern for application of the brakes, such as braking periods interspersed with non-braking periods, (j) an intensity at which the brakes should be applied, (k) a pattern of intensity at which the brakes should be applied, such as high intensity followed by a decrease in intensity over time, (l) or any other characteristic or combination of characteristics corresponding to the application of brakes.

In some examples, processor 110 may be configured to determine two or more braking characteristics based on the deceleration request. For instance, both the current speed and a difference between the current speed and the target speed may be determined.

Then based on the determined braking characteristic(s), processor 110 may be configured to determine a noise signal. The noise signal may correspond to an expected noise generated by the brake system 106. For instance, if the current speed is 50 MPH, and the target speed is 40 MPH, a particular noise signal generated by the braking system may be expected. The generated noise signal may be expected based on a known response of the brake system for the determined braking characteristics of the current speed and the target speed. For a current speed of 50 MPH and a requested deceleration down to 40 MPH, it may be known that the brake system motor may run at 2000 RPM for three seconds. And where the current speed is 60 MPH with a requested deceleration down to 40 MPH, it may be known that the brake system motor may run at 2200 RPM for 5 seconds. These values are for illustration only, and may not reflect actual values used by a given vehicle.

In some examples, one or more laboratory, manufacturer, workshop, or other tests may be run for a vehicle to determine a set of predicted noise signals for a variety of braking characteristics. As such, the vehicle 100 may include a stored list, array, or other data structure having a plurality of possible noise signals that may be produced by the brake system under varying conditions, such as vehicle speeds, requested speeds, decelerations amounts, duration of brake application, etc. (i.e., the braking characteristics listed above).

The stored noise signals may be determined by measuring the noise generated by the brake system under various circumstances, and generating respective 180 degree out of phase signals. The out of phase signals may have a corresponding or identical frequency profile, and are out of phase by 180 degrees. Thus, when both the noise from the brake system and the selected out of phase signal are emitted, they may cancel out or result in a reduced magnitude combined signal based on destructive interference.

Processor 110 may be configured to determine a particular noise signal, such as by selecting a noise signal from the stored list, based on the braking characteristics determined from the received deceleration request.

And processor 110 may then be configured to output the determined noise signal via the noise cancellation system 104 into the cabin of vehicle 100, to reduce the noise caused by the brake system 106 and head by a passenger of the vehicle 100.

In some examples, the processor 110 may further be configured to determine a magnitude of the output noise signal based on one or more factors. The magnitude may depend on the current vehicle speed, or any other braking characteristic, such that a high vehicle speed corresponds to a greater magnitude (in order to cancel out the louder noise signal from the brake system).

Figure 2:
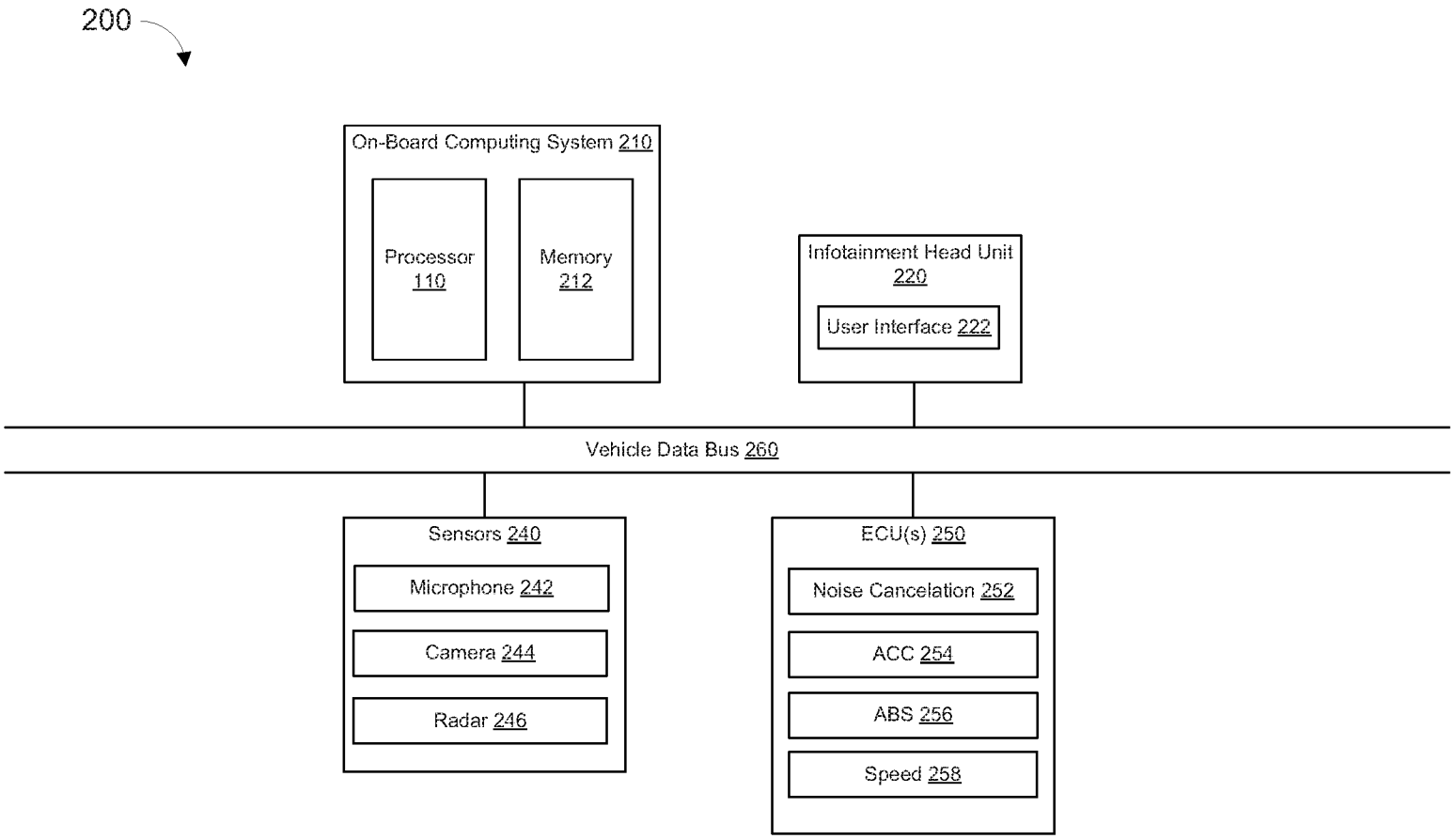
FIG. 2 illustrates an example block diagram of electronic components of the vehicle of FIG. 1.

FIG. 2 illustrates an example block diagram 200 showing electronic components of vehicle 100, according to some embodiments. In the illustrated example, the electronic components 200 include the on-board computing system 210, infotainment head unit 220, sensors 240, electronic control unit(s) 250, and vehicle data bus 260.

The on-board computing system 210 may include a microcontroller unit, controller or processor 110 and memory 212. Processor 110 may be any suitable processing device or set of processing devices such as, but not limited to, a microprocessor, a microcontroller-based platform, an integrated circuit, one or more field programmable gate arrays (FPGAs), and/or one or more application-specific integrated circuits (ASICs). The memory 212 may be volatile memory (e.g., RAM including non-volatile RAM, magnetic RAM, ferroelectric RAM, etc.), non-volatile memory (e.g., disk memory, FLASH memory, EPROMs, EEPROMs, memristor-based non-volatile solid-state memory, etc.), unalterable memory (e.g., EPROMs), read-only memory, and/or high-capacity storage devices (e.g., hard drives, solid state drives, etc.). In some examples, the memory 212 includes multiple kinds of memory, particularly volatile memory and non-volatile memory.

The memory 212 may be computer readable media on which one or more sets of instructions, such as the software for operating the methods of the present disclosure, can be embedded. The instructions may embody one or more of the methods or logic as described herein. For example, the instructions reside completely, or at least partially, within any one or more of the memory 212, the computer readable medium, and/or within the processor 110 during execution of the instructions.

The terms "non-transitory computer-readable medium" and "computer-readable medium" include a single medium or multiple media, such as a centralized or distributed database, and/or associated caches and servers that store one or more sets of instructions. Further, the terms "non-transitory computer-readable medium" and "computer-readable medium" include any tangible medium that is capable of storing, encoding or carrying a set of instructions for execution by a processor or that cause a system to perform any one or more of the methods or operations disclosed herein. As used herein, the term "computer readable medium" is expressly defined to include any type of computer readable storage device and/or storage disk and to exclude propagating signals.

The infotainment head unit 220 may provide an interface between vehicle 100 and a user. The infotainment head unit 220 may include one or more input and/or output devices in the form of a user interface 222 having one or more input devices and output devices. The input devices may include, for example, a control knob, an instrument panel, a digital camera for image capture and/or visual command recognition, a touch screen, an audio input device (e.g., cabin microphone), buttons, or a touchpad. The output devices may include instrument cluster outputs (e.g., dials, lighting devices), actuators, a heads-up display, a center console display (e.g., a liquid crystal display (LCD), an organic light emitting diode (OLED) display, a flat panel display, a solid state display, etc.), and/or speakers. In the illustrated example, the infotainment head unit 220 includes hardware (e.g., a processor or controller, memory, storage, etc.) and software (e.g., an operating system, etc.) for an infotainment system (such as SYNC® and MyFord Touch® by Ford®, Entune® by Toyota®, IntelliLink® by GMC®, etc.). In some examples the infotainment head unit 220 may share a processor with on-board computing system 210. Additionally, the infotainment head unit 220 may display the infotainment system on, for example, a center console display of vehicle 100.

Sensors 240 may be arranged in and around the vehicle 100 in any suitable fashion. In the illustrated example, sensors 240 may include a microphone 242, camera 244, and radar 246. Microphone 242 may be used by the noise cancellation system in order to perform one or more noise cancellation function. Camera 244 and/or radar 246 may be used to determine a distance to a leading vehicle. Other sensors may be included as well. Information from the various sensors 240 may be used by processor 110 to make one or more determinations or carry out one or more actions such as those described herein.

The ECUs 250 may monitor and control subsystems of vehicle 100. ECUs 250 may communicate and exchange information via vehicle data bus 260. Additionally, ECUs 250 may communicate properties (such as, status of the ECUs 250, sensor readings, control state, error and diagnostic codes, etc.) to and/or receive requests from other ECUs 250. Some vehicles may have seventy or more ECUs 250 located in various locations around the vehicle communicatively coupled by vehicle data bus 360. ECUs 250 may be discrete sets of electronics that include their own circuit (s) (such as integrated circuits, microprocessors, memory, storage, etc.) and firmware, sensors, actuators, and/or mounting hardware. In the illustrated example, ECUs 250 may include the noise cancellation system 252, ACC 254, ABS 256, and speed control unit 258. These control units may be similar or identical to the noise cancellation, ACC, brake system, and other features described with respect to FIG. 1.

Vehicle data bus 260 may include one or more data buses that communicatively couple the on-board computing system 210, infotainment head unit 220, sensors 240, ECUs 250, and other devices or systems connected to the vehicle data bus 260. In some examples, vehicle data bus 260 may be implemented in accordance with the controller area network (CAN) bus protocol as defined by International Standards Organization (ISO) 11898-1. Alternatively, in some examples, vehicle data bus 260 may be a Media Oriented Systems Transport (MOST) bus, or a CAN flexible data (CAN-FD) bus (ISO 11898-7).

Figure 3:
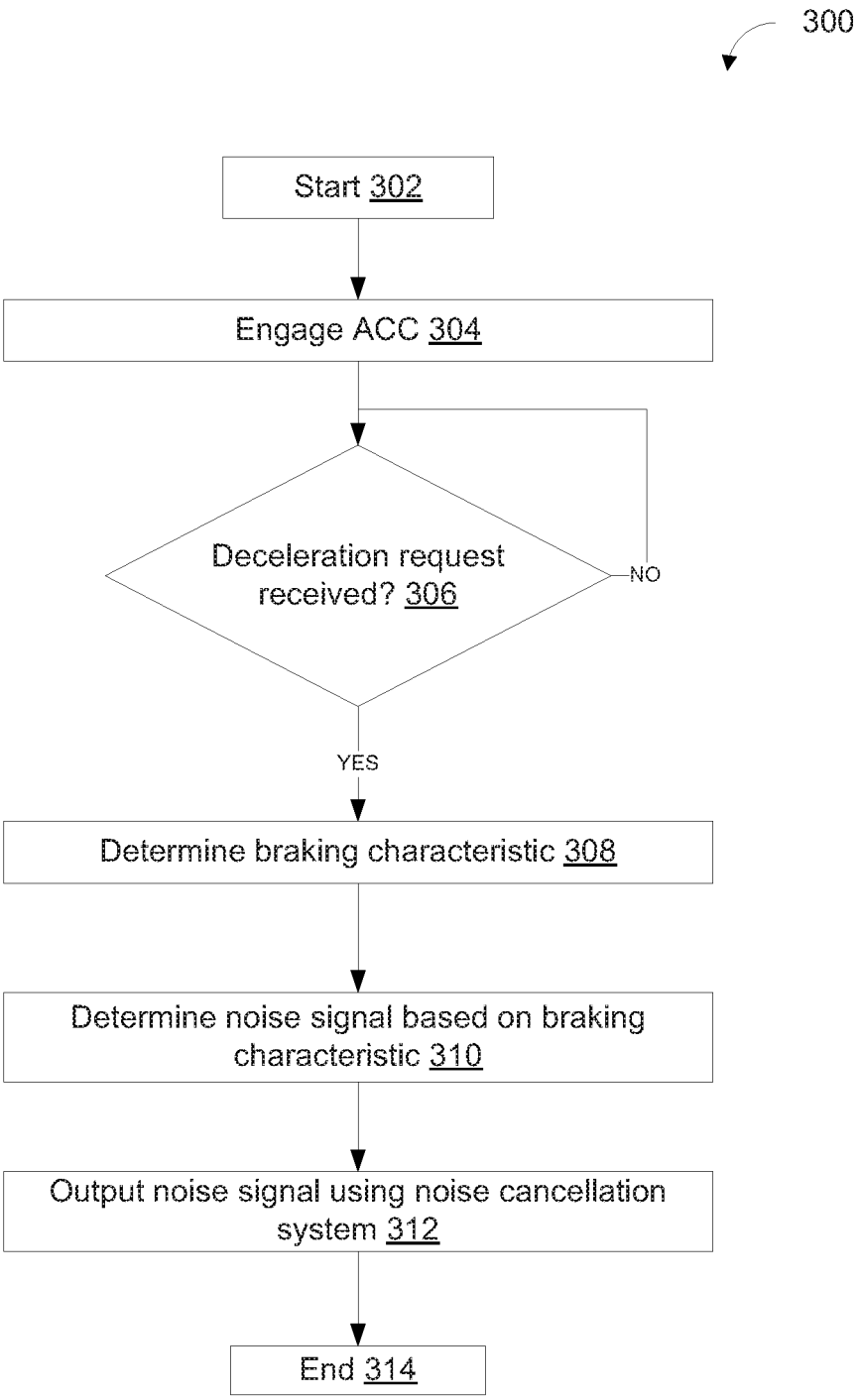
FIG. 3 illustrates a flowchart of an example method according to embodiments of the present disclosure.

FIG. 3 illustrates a flowchart of an example method 300 according to embodiments of the present disclosure. Method 300 may enable a vehicle to cancel or reduce noise generated by a brake system while adaptive cruise control is active. The flowchart of FIG. 3 is representative of machine readable instructions that are stored in memory (such as memory 212) and may include one or more programs which, when executed by a processor (such as processor 110) may cause vehicle 100 and/or one or more systems or devices to carry out one or more functions described herein. While the example program is described with reference to the flowchart illustrated in FIG. 3, many other methods for carrying out the functions described herein may alternatively be used. For example, the order of execution of the blocks may be rearranged or performed in series or parallel with each other, blocks may be changed, eliminated, and/or combined to perform method 300. Further, because method 300 is disclosed in connection with the components of FIGS. 1-2, some functions of those components will not be described in detail below.

Method 300 may start at block 302. At block 304 method 300 may include engaging the ACC system. This may include turning on cruise control, or otherwise enabling the vehicle to automatically adjust the vehicle speed without requiring the driver to push the gas or brake pedals.

At block 306, method 300 may include determining whether a deceleration request has been received. As noted above, a deceleration request may be initiated or transmitted by one or more vehicle sensors, or via a user interface of the vehicle.

If a deceleration request has been received, block 308 of method 300 may include determining a braking characteristic corresponding to the deceleration request. The braking characteristic may include a current or target speed, acceleration, jerk, time of brake application, or any other braking characteristic, such as those described in this disclosure.

At block 310, method 300 may include determining a noise signal based on the braking characteristic determining in block 308. This may include selecting a noise signal from a plurality of stored noise signals that were previously generated. The vehicle may store a list of a plurality of potential noise signals, and one may be selected based on the particular braking characteristic or characteristics determined from the deceleration request.

The selected noise signal may be a signal having a similar or identical frequency profile to the expected noise that will be generated by the braking system if the braking request is satisfied. As such, block 312 of method 300 may include outputting the noise signal using the noise cancellation system, in order to destructively interfere with the noise generated by the brake system to reduce the overall noise in the vehicle cabin.

In some examples, the noise signal may be output based on the received deceleration request. For instance, if the deceleration is supposed to last for four second, the selected noise signal may be output for four seconds. Further, in some cases each noise signal stored by the vehicle may include a timing element, such that the magnitude, frequency, or another aspect of the signal changes over time. As such, where the deceleration request corresponds to a particular noise signature (e.g., frequency, magnitude, or other changes over time), the selected noise signal may mirror the noise signature. And in some examples, the noise cancellation system may be configured to provide feedback regarding the actual noise generated by the braking system, such that one or more stored noise signals may be modified as the brake system changes over time.

Method 300 may then end at block 314.

In this application, the use of the disjunctive is intended to include the conjunctive. The use of definite or indefinite articles is not intended to indicate cardinality. In particular, a reference to "the" object or "a" and "an" object is intended to denote also one of a possible plurality of such objects. Further, the conjunction "or" may be used to convey features that are simultaneously present instead of mutually exclusive alternatives. In other words, the conjunction "or" should be understood to include "and/or". The terms "includes," "including," and "include" are inclusive and have the same scope as "comprises," "comprising," and "comprise" respectively.

The above-described embodiments, and particularly any "preferred" embodiments, are possible examples of implementations and merely set forth for a clear understanding of the principles of the invention. Many variations and modifications may be made to the above-described embodiment (s) without substantially departing from the spirit and principles of the techniques described herein. All modifications are intended to be included herein within the scope of this disclosure and protected by the following claims.

What is claimed is:

1. A vehicle comprising:
adaptive cruise control (ACC);
a noise cancellation system;
one or more vehicle sensors configured to generate a deceleration request based on a position of a leading vehicle;
a brake system; and
a processor configured to:
receive the deceleration request while the ACC is active;
determine a braking characteristic based on the deceleration request;
determine a noise signal based on the braking characteristic; and
output the noise signal via the noise cancellation system.

2. The vehicle of claim 1, wherein the braking characteristic comprises a target speed.

3. The vehicle of claim 1, wherein the processor is further configured to determine a current vehicle speed, and wherein the braking characteristic comprises a difference between the current vehicle speed and a target speed.

4. The vehicle of claim 1, wherein the processor is further configured to determine a magnitude of the noise signal based on a current vehicle speed.

5. The vehicle of claim 1, wherein the braking characteristic comprises an amount of deceleration.

6. The vehicle of claim 1, wherein the braking characteristic comprises an amount of jerk.

7. The vehicle of claim 6, wherein the processor is further configured to determine a magnitude of the noise signal based on the amount of jerk.

8. The vehicle of claim 1, wherein the noise signal comprises a first noise signal, the brake system is configured to generate a second noise signal based on the deceleration request, and wherein the first noise signal (i) has a frequency profile corresponding to the second noise signal and (ii) is 180 degrees out of phase with the second noise signal.

9. The vehicle of claim 1, wherein the processor is further configured to determine the noise signal by selecting the noise signal from a plurality of stored predetermined signals determined by a manufacturer of the vehicle.

10. A method for canceling vehicle noise comprising:
receiving, by a vehicle processor, a deceleration request while an adaptive cruise control is active;
determining a current vehicle speed;
determining a braking characteristic of a brake system based on the deceleration request, wherein the braking characteristic comprises a difference between the current vehicle speed and a target speed;
determining a noise signal based on the braking characteristic; and
outputting the noise signal via a noise cancellation system.

11. The method of claim 10, further comprising generating the deceleration request based on a position of a leading vehicle, wherein the position of the leading vehicle is determined by one or more vehicle sensors.

12. The method of claim 10, wherein the braking characteristic comprises a target speed.

13. The method of claim 10, further comprising determining a magnitude of the noise signal based on a current vehicle speed.

14. The method of claim 10, wherein the braking characteristic comprises an amount of deceleration.

15. The method of claim 10, wherein the braking characteristic comprises an amount of jerk.

16. The method of claim 15, further comprising determining a magnitude of the noise signal based on the amount of jerk.

17. The method of claim 10, wherein the noise signal comprises a first noise signal, the brake system is configured to generate a second noise signal based on the deceleration request, and wherein the first noise signal (i) has a frequency profile corresponding to the second noise signal and (ii) is 180 degrees out of phase with the second noise signal.

18. The method of claim 10, further comprising determining the noise signal by selecting the noise signal from a plurality of stored predetermined signals determined by a vehicle manufacturer.

19. A vehicle comprising:
adaptive cruise control (ACC);
a noise cancellation system;
a brake system; and
a processor configured to:
receive a deceleration request while the ACC is active;
determine a current vehicle speed;
determine a braking characteristic based on the deceleration request, wherein the braking characteristic comprises a difference between the current vehicle speed and a target speed;
determine a noise signal based on the braking characteristic; and
output the noise signal via the noise cancellation system.

* * * * *